US006135797A

United States Patent [19]

McCleerey et al.

[11] Patent Number: 6,135,797

[45] Date of Patent: Oct. 24, 2000

[54] ELECTRICAL CONNECTOR WITH FLOATING HOUSING

[75] Inventors: Earl William McCleerey, Mechanicsburg; Michael Eugene Shirk, Grantville; Melissa Ann Sherman, Mechanicsburg, all of Pa.

[73] Assignee: The Whitaker Corporation, Wilmington, Del.

[21] Appl. No.: 09/133,633

[22] Filed: Aug. 13, 1998

[51] Int. Cl.[7] ..... H01R 13/64

[52] U.S. Cl. ..... 439/248; 439/247; 439/534; 439/326; 439/327

[58] Field of Search ..... 439/247, 248, 439/534, 326, 327, 325, 328, 59, 60, 61, 62, 64

[56] References Cited

U.S. PATENT DOCUMENTS

| | | | |
|---|---|---|---|
| 4,756,694 | 7/1988 | Billman et al. | 439/61 |
| 4,808,115 | 2/1989 | Norton et al. | 439/79 |
| 4,808,125 | 2/1989 | Waters et al. | 439/607 |
| 4,824,387 | 4/1989 | Dejong et al. | 439/248 |
| 5,259,779 | 11/1993 | Ooya et al. | 439/247 |
| 5,556,286 | 9/1996 | Ikesugi et al. | 439/74 |
| 5,816,838 | 10/1998 | Del Prete et al. | 439/326 |
| 5,820,391 | 10/1998 | Delprete et al. | 439/91 |
| 5,899,767 | 3/1999 | Kato et al. | 439/247 |
| 5,902,149 | 5/1999 | Tashiro et al. | 439/557 |

FOREIGN PATENT DOCUMENTS

| | | | |
|---|---|---|---|
| 7-230858 | 8/1995 | Japan | H01R 23/02 |

OTHER PUBLICATIONS

Augat Drawing No. 619–200220–XX–X drawn May 29, 1997, 1 page; Augat, Inc., Attleboro Falls, MA.

Miniature Card Specification, PCMCIA Document, No. 0201, Release 002, Jul. 14, 1997, 14 pages; Personal Computer Memory Card International Assoc., San Jose, CA.

Miniature Card Specification Release 1.1, 18 pages (date unknown) ; Personal Computer Memory Card International Assoc., San Jose, CA.

*Primary Examiner*—Paula Bradley
*Assistant Examiner*—Truc Nguyen

[57] ABSTRACT

A connector includes a connector base, a contact housing, and a floating latch. The connector base has a first bottom surface, and the contact housing has a second bottom surface. The floating latch couples the contact housing to the connector base. The floating latch is adapted to allow the first and second bottom surfaces to move relative to one another.

6 Claims, 10 Drawing Sheets

ELECTRICAL CONNECTOR WITH FLOATING HOUSING

BACKGROUND OF THE INVENTION

1. FIELD OF THE INVENTION

This invention relates generally to electrical connectors, and more particularly, to an electrical connector having a floating housing.

2. DESCRIPTION OF THE RELATED ART

Digital devices have been developed that use removable modules for expanding the capabilities of the device. These modules are removably coupled to the device to providing additional memory capacity, functionality, or both. Connectors have been developed for interfacing the modules with the device. Because the modules have the potential for frequent handling by the user of the device, the connector must effectively couple the module to the device electrically and mechanically. One application for a removable module is to provide a memory pack (flash or dynamic RiM) for a digital camera. The memory pack stores images captured by the digital camera (not shown), and may be frequently removed to transfer images or to attach an unused memory pack (i.e., similar to changing the film in a typical camera).

One such module is called a mini-card. An elastomeric connector having alternating vertical layers of conductive and non-conductive elastomer is mounted by compression to the camera printed circuit board The elastomeric connector is compressed to fit in a notch in the mini-card. The compression causes the conductive layers to form an electrical connection between the camera printed circuit board contacts and the corresponding mini-card contacts. The elastomeric material of the connector is subject to age and environmental based degradation, causing the quality of the electrical connections thereto to vary over the life of the camera. The material and mounting methods used with the elastomeric connector make it unsuitable for production methods such as surface mounting where the components are heated during the mounting process.

The present invention is directed to overcoming, or at least reducing the effects of, one or more of the problems set forth above.

SUMMARY OF THE INVENTION

One aspect of the present invention is seen in a connector including a connector base, a contact housing, and a floating latch. The connector base has a first bottom surface, and the contact housing has a second bottom surface. The floating latch couples the contact housing to the connector base. The floating latch is adapted to allow the first and second bottom surfaces to move relative to one another.

BRIEF DESCRIPTION OF THE DRAWINGS

The invention may be understood by reference to the following description taken in conjunction with the accompanying drawings, in which like reference numerals identify like elements, and in which.

Figure 1:
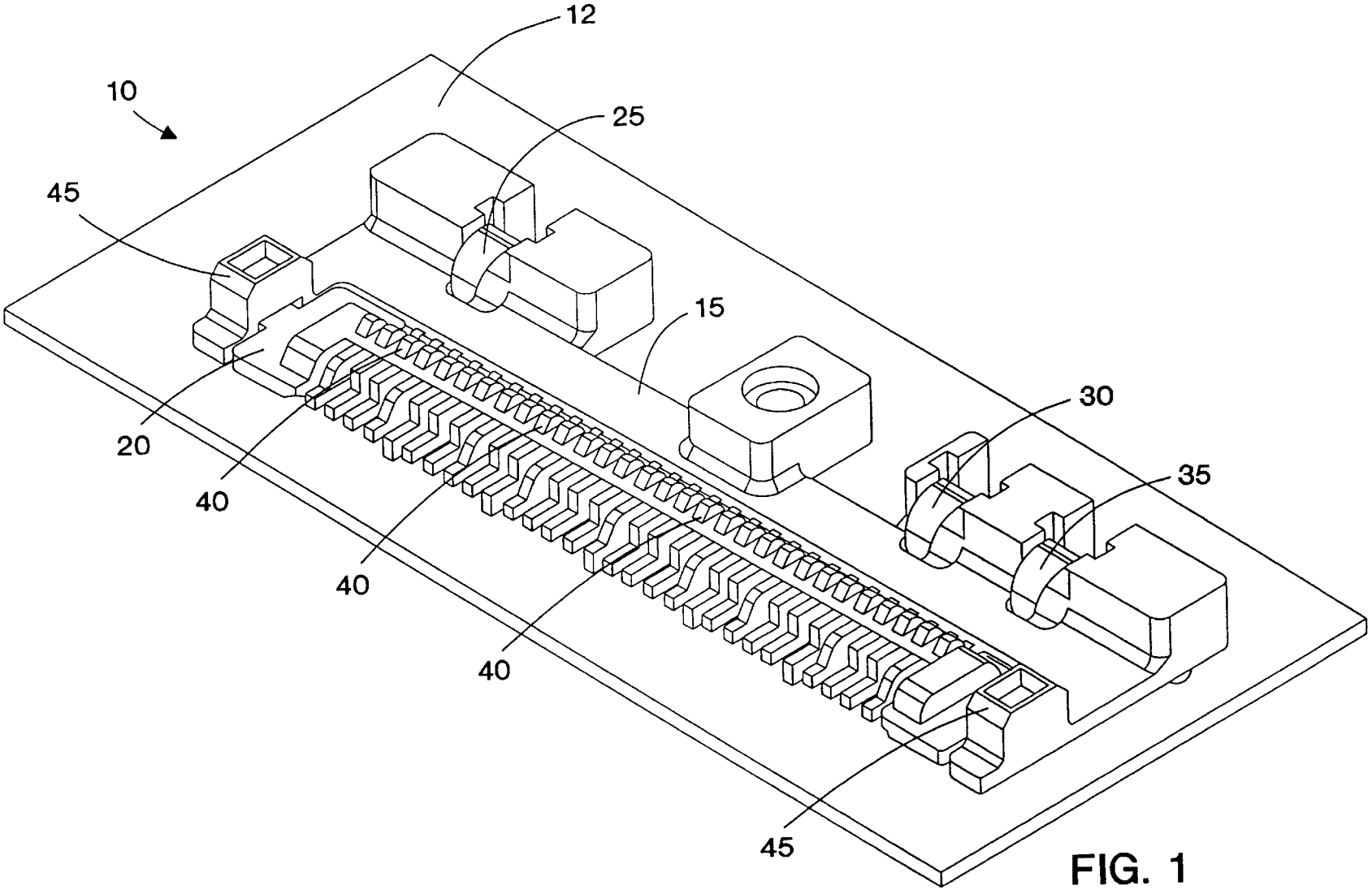
FIG. 1 is an isometric view of a connector in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
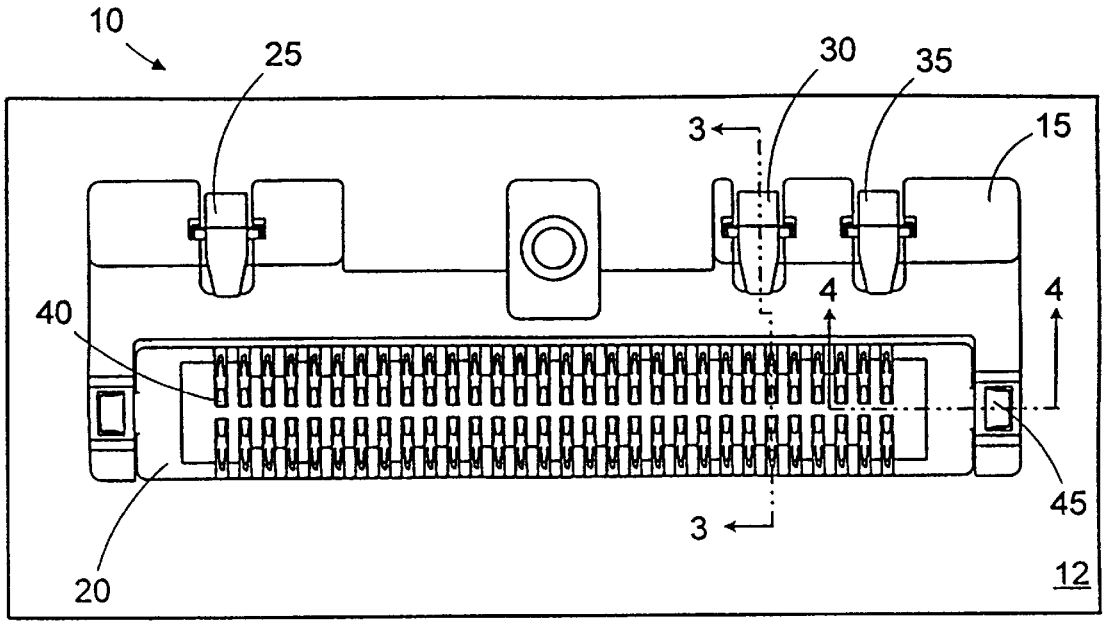
FIG. 2 is a top view of the connector of FIG. 1.

Referring first to FIG. 1, an isometric view of a connector 10 is provided. The connector 10 is mounted to a printed circuit board 12 (not shown in its entirety). FIG. 2 illustrates a top view of the connector 10 of FIG. 1. The connector 10 includes a connector base 15 and a contact housing 20. The connector base 15 houses a plurality of base contacts, including a power contact 25, a ground contact 30, and a notification contact 35. The contact housing 20 houses a plurality of signal contacts 40 arranged in parallel rows. The base contacts 25, 30, 35 and the signal contacts 40 may be gold plated to enhance electrical contact with their corresponding interfacing contacts (not shown). The contact housing 20 is secured to the connector base 15 by a floating latch 45. In the illustrated embodiment, the contact housing 20 houses sixty signal contacts 40 arranged in two equally divided, parallel rows. Each signal contact is about 0.4 mm wide and adjacent signal contacts 40 are spaced by about 1.0 mm on center.

Figure 3:
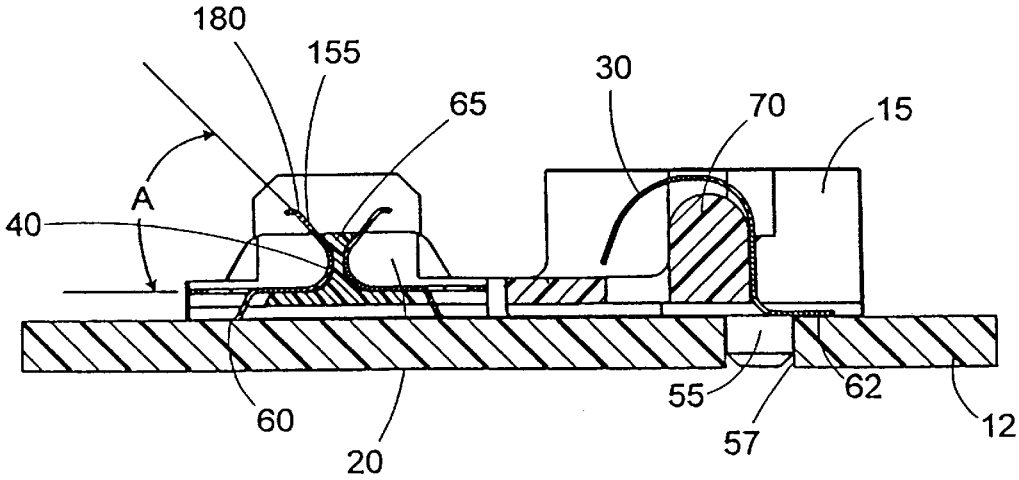
FIG. 3 is a cross-sectional view of the connector of FIG. 2 taken along line 3—3.
Figure 4:
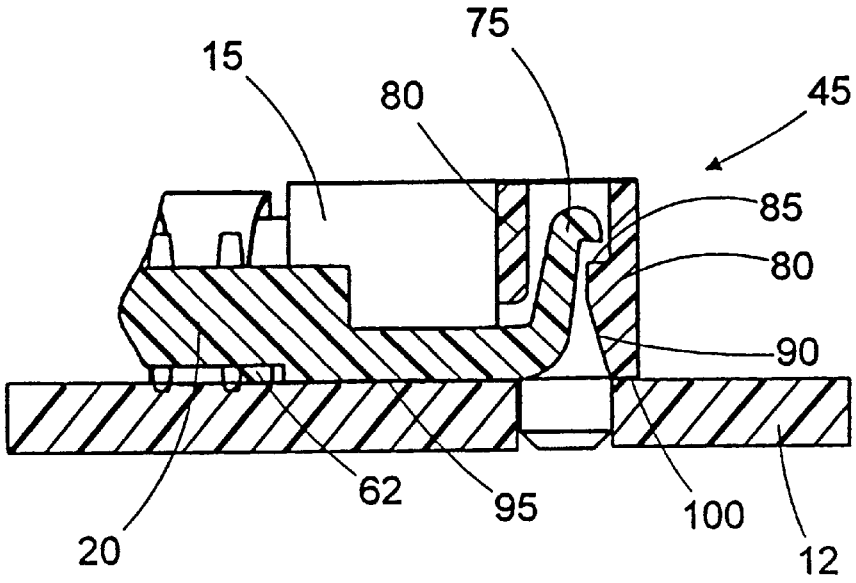
FIG. 4 is a cross-sectional view of the connector of FIG. 2 taken along line 4—4.

Turning now to FIGS. 3 and 4, cross-sectional views of the connector 10 taken along lines 3—3 and 4—4 of FIG. 2 are illustrated, respectively. FIG. 3 shows in greater detail the arrangement of the signal contacts 40 in the contact housing 20 and the ground contact 30 in the connector base 15. In the illustrated embodiment, the power contact 25, ground contact 30, and the notification contact 35 are of similar construction. The connector base 15 includes a locating post 55 for aligning the connector 10 with the printed circuit board 12 to which the connector 10 is mounted. The locating post 55 cooperates with a corresponding hole 57 on the printed circuit board 12.

The signal contact 40 includes a printed circuit board (PCB) foot 60 for making electrical contact with the printed circuit board 12. A preload structure 65 defined in the contact housing 20 preloads the signal contacts 40 to increase normal forces between the signal contacts 40 and the interfacing contact (not shown). The ground contact 30 also includes a PCB foot 62 for making electrical contact with the printed circuit board 12. The base contacts 25, 30, 35 have a C-shaped cross section. The connector base 15 includes a support structure 70 for supporting the base contacts 25, 30, 35. The base contacts 25, 30, 35 are retained in the connector base 15 by an interference fit. The mating of the base contacts 25, 30, 35 and the signal contacts 40 with an interfacing connector (not shown) is described in greater detail below in reference to FIG. 8.

FIG. 4 shows in greater detail the arrangement of the floating latch 45 coupling the connector base 15 and the contact housing 20. The floating latch 45 includes a hook 75 defined in the contact housing 20 and a fastening flange 80 defined in the connector base 15. A ledge 85 is defined in the fastening flange 80 for engaging the hook 75. The fastening flange 80 also includes an angled sidewall 90 that functions to deflect the hook 75 as it is being inserted into the fastening flange 80. Once fully inserted, the hook 75 returns to its undeflected shape as shown in FIG. 4. The ledge 85 acts as a catch, preventing the hook 75 from being withdrawn from the fastening flange 80. Although the ledge 85 prevents the hook 75 from being withdrawn, it does not rigidly secure the hook 75 within the fastening flange 80. Accordingly, the connector base 15 and contact housing 20 are also not rigidly secured to one another (i.e., the connector base 15 and the contact housing 20 are allowed to float relative to each other).

The connector base 15 may move with respect to the contact housing 20 to conform to the surface of the printed circuit board 12 to which the connector 10 is to be mounted. After the connector 10 is mounted (e.g., soldered) to the printed circuit board 12, the floating latch 45 allows movement of the contact housing 20 with respect to the connector base 15 in response to flexing or warping of the printed circuit board 12 without stressing the solder connections made at the PCB feet 60, 62. In other words, the bottom surface 95 of the contact housing 20 need not be coplanar with the bottom surface 100 of the connector base 15. Also the contact housing 20 shown in FIGS. 1 and 2 may be slightly tilted or rotated to conform to the surface of the printed circuit board 12.

The flexibility provided by the floating latch 45 aids the initial alignment of the connector 10 on the printed circuit board 12 during fabrication. Certain mounting techniques (e.g., surface mounting with solder paste) only permit small forces to be applied to the components being placed on the printed circuit board 12. Accordingly, the connector 10 must conform to the surface of the printed circuit board 12 without needing an applied force to seat the PCB feet 60, 62 with the corresponding interfacing connectors (not shown) on the printed circuit board 12.

The floating latch 45 allows the bottom surface 95 of the contact housing 20 and the bottom surface 100 of the connector base 15 to independently conform to the printed circuit board 12 increasing the likelihood of proper mating of the PCB feet 60, 62. In a surface mount process, typically 0.006 inches of solder paste are applied to the interfacing contacts of the printed circuit board 12. After heating to melt the paste and complete the solder connections, the resulting solder thickness is about 0.003 inches. If any of the PCB feet 60, 62 do not adequately contact the paste, a sound solder connection will not be created during the surface mount process. A small amount of warping in the printed circuit board 12 could result in a weak solder connection or prevent proper electrical connection between the connector 10 and the printed circuit board 12. An increase in the amount of warp due to age or temperature could break the weak solder connection, resulting in failure of the connector 10.

Figure 5:
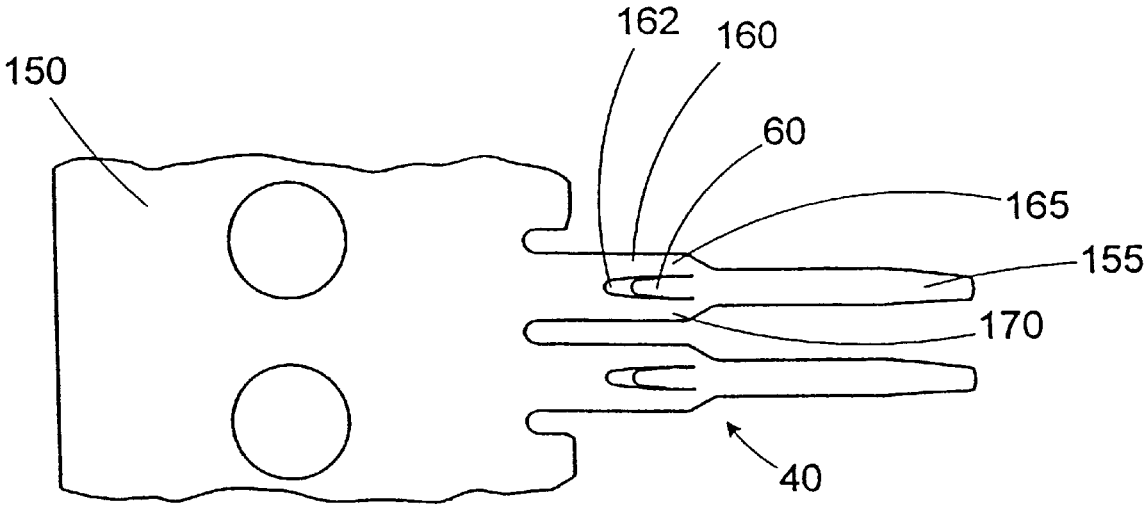
FIG. 5 is a top view of a carrier strip used for forming the signal contacts of the connector of FIG. 1.

Referring to FIG. 5, a top view of a carrier strip 150 used for forming the signal contacts 40 is shown. The signal contacts 40 are formed in a comb arrangement on the carrier strip 150. Each signal contact 40 includes a finger 155, and a base 160. The PCB foot 60 is formed (e.g., by stamping) into the base 160. The formation of the PCB foot 60 results in a hole 162 being defined in the base 160 above the foot 60. Retaining tabs 165, 170 defined in the periphery of the base 160. The retaining tabs 165, 170 of the base 160 are used in securing the signal contact 40 into the contact housing 20 as described in greater detail below in reference to FIG. 7.

Figure 6:
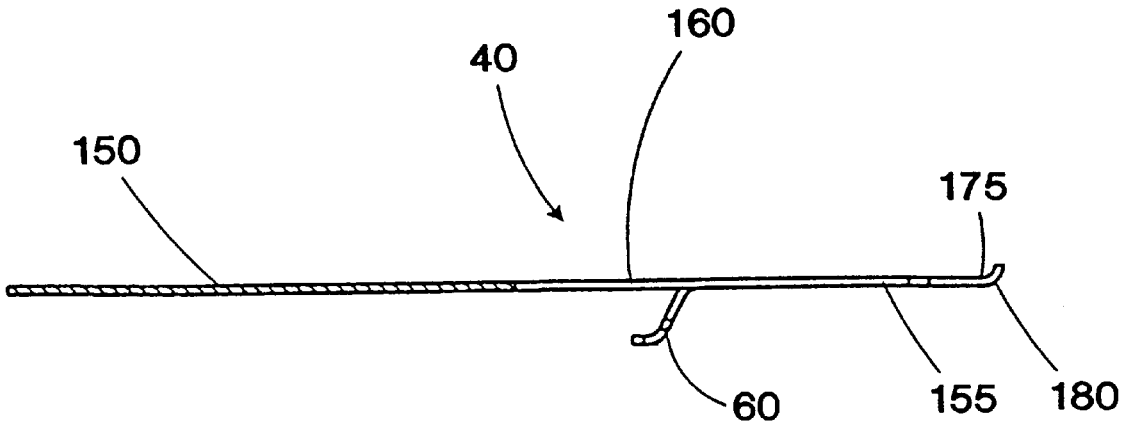
FIG. 6 is a side view of the carrier strip of FIG. 5.

FIG. 6 illustrates a side view of the carrier strip 150 including the signal contacts 40. The finger 155 includes a curved end 175. A contact area 180 is formed on the curved end 175 by gold plating at least the outer radial surface of the curved end 175. Before inserting the signal contacts 40 into the contact housing 20, the finger 155 is curved to form the shape shown in FIG. 3. As shown in FIG. 3, the deflection angle A between the base 160 and the curved end 175 is about 60°. In one embodiment, the finger 155 is curved to a deflection angle of about 90° before being inserted into the contact housing 20. The preload structure 65 forces the finger 155 to its final deflection angle of about 60°, thus preloading the finger 155 shown in FIG. 3 to increase the normal forces between the contact area 180 and the interfacing mini-card contact (not shown). The finger 155 may be curved to a greater or lesser angle, such as between about 50° and about 120°, before being inserted into the contact housing 20 depending on the amount of preload desired from the preload structure 65. It is also contemplated that the final deflection angle resulting from the interaction between the finger 155 and the preload structure 65 may vary depending on the specific application. For example, the final deflection angle may be less than about 70°.

Figure 7:
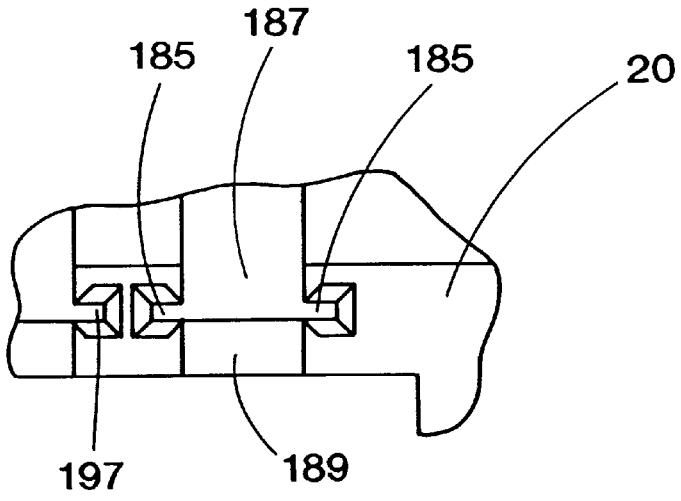
FIG. 7 is an enlarged view of a front portion of the contact housing of the connector of FIG. 1.

An enlarged side view of a portion of the contact housing 20 is shown in FIG. 7. In the illustrated embodiment, the carrier strip 150 is initially integrally joined to 30 signal contacts 40 that are inserted simultaneously into the contact housing 20. The carrier strip 150 is removed (e.g., by breaking or cutting) after being inserted, leaving the individual signal contacts 40 secured in the contact housing 20.

Retention channels 185 (shown in FIGS. 7, 10, and 11) are formed in the contact housing 20 for receiving the retaining tabs 165, 170 (shown in FIG. 5) as the signal contacts 40 are inserted into the contact housing 20. Either one or both of the height and width of the retention channels 185 are smaller than the corresponding dimension on the retaining tabs 165, 170 defined in the base 160, thereby creating an interference fit, where the signal contact 40 is frictionally retained in the contact housing 20 by the retention channels 185. The finger 55 is received in an upper slot 187 defined in the contact housing 20 and the PCB foot 60 is received in a lower slot 189 defined in the contact housing 20.

As described above, the PCB foot 60 is formed in the base 160 in parallel with the retaining tabs 165, 170 used for retaining the signal contact 40 in the contact housing 20. In a typical contact (not shown), a foot is formed at an end of the contact behind the retention portion. By forming the PCB foot 60 in parallel with the base 160, the ratio of the beam length of the signal contact 40 (i.e., the length of the finger) to the overall length of the signal contact 40 is increased. As a result, a smaller footprint is achieved without reducing the spring characteristics of the signal contact 40. In the illustrated embodiment, the length of the finger 155 (i.e., beam length) is about 0.120 inches and the overall length of the signal contact 40 is about 0.190 inches. As a result, the ratio of the beam length to contact length is about 0.63. It is contemplated that the ratio of the beam length to contact 40 length may vary depending on the specific application. For example, the ratio of the beam length to contact length may be greater than about 0.5.

Figure 12:
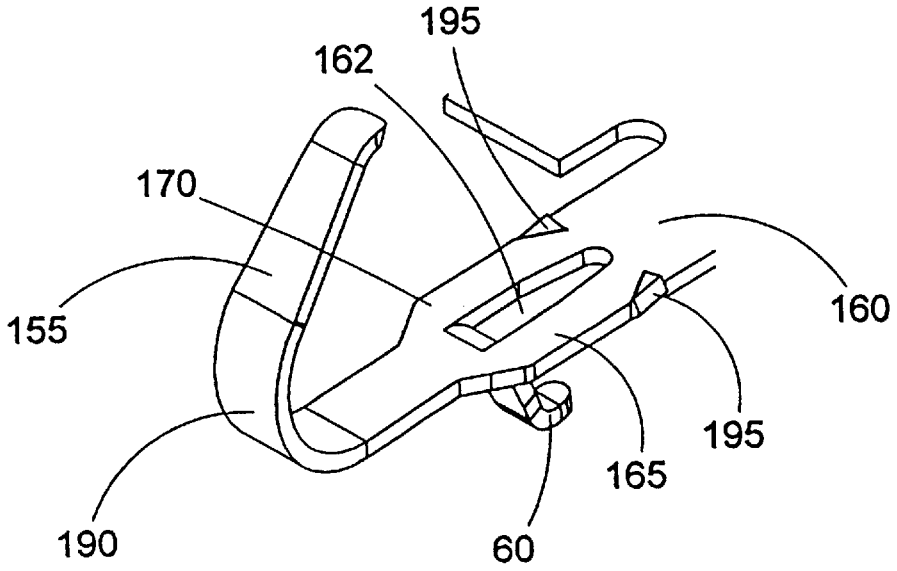
FIG. 12 is an isometric view of an alternative signal contact.

Referring briefly to FIG. 12, an isometric view of an alternative signal contact 190 is provided. The signal contact 190 includes barbs 195 formed in the retaining tabs 165, 170. The barbs 195 may be stamped into the base 160 during the manufacture of the signal contact 190. The barbs 195 frictionally interface with the retention channels 185 to enhance the interference fit therebetween. The barbs 195 do not significantly impede the insertion of the signal contact 40 into the retention channels 185. However, if a force urges the signal contact 40 in a direction out of the retention channels 185, the barbs 195 will bite into the material of the contact housing 20 forming the upper walls 197 (see FIGS. 7 an 11) of the retention channels 185 and impede the withdrawal of the signal contact 40.

Figure 8:
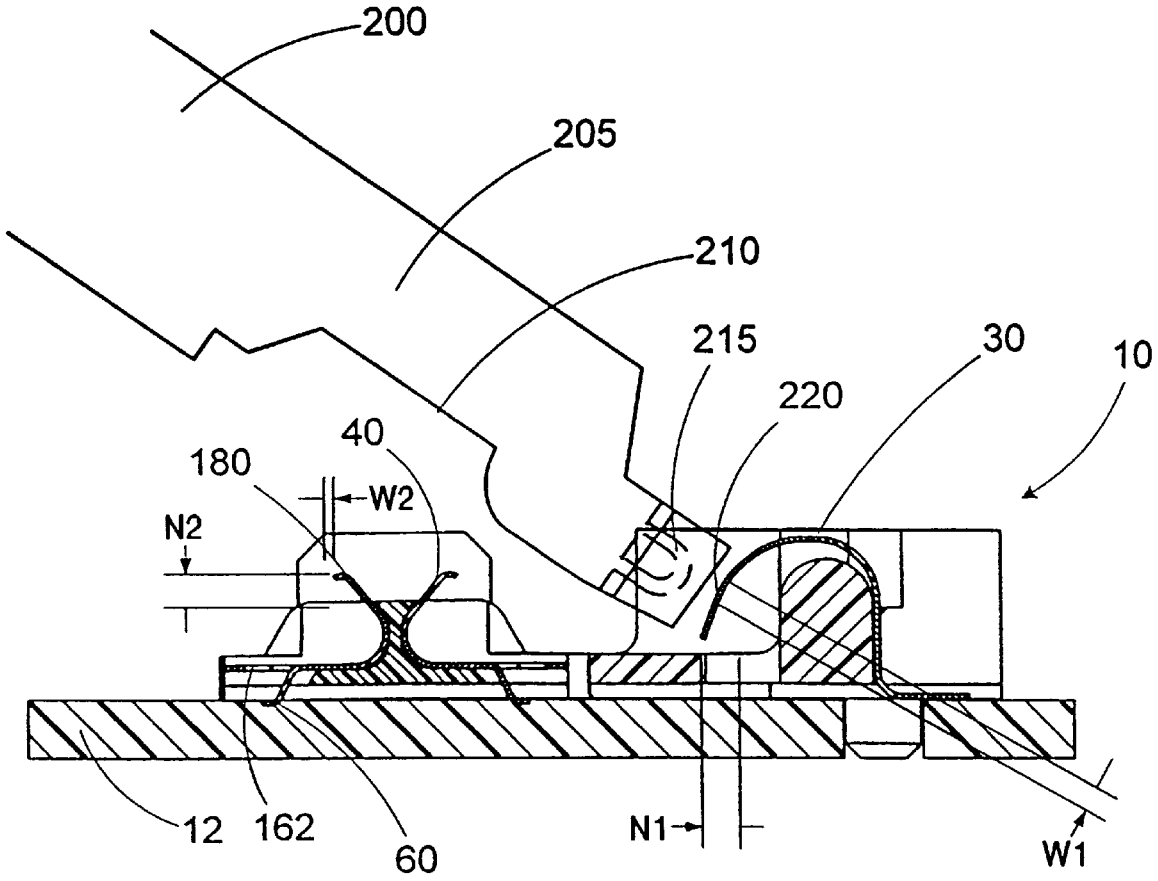
FIG. 8 is a side cross-sectional view of the connector as shown in FIG. 3 further including a mini-card being coupled to the connector.

FIG. 8 illustrates the side cross-sectional view of the connector 10 shown in FIG. 3 as a mini-card 200 is being coupled to the connector 10. The mini-card 200 is inserted at an angle and rotated downwardly until connection between the mini-card 200 and the connector 10 is made. The mini-card includes a notch 205 for receiving the contact housing 20. Mini-card signal contacts (not shown) are located on a top surface 210 of the notch 205. The mini-card 200 also includes mini-card base contacts 215. The base contacts 25, 30, 35 of the connector 10 contact corresponding mini-card base contacts 215, and the signal contacts 40 contact the mini-card signal contacts (not shown). As the notification contact 35 of the connector contacts the mini-card base contact 215, a signal is sent to the device (not shown) that includes the printed circuit board 12 to indicate that the mini-card 200 is being installed. After installation, the mini-card 200 is essentially coplanar with the printed circuit board 12.

The particular base contact 25, 30, 35 visible in FIG. 8 is the ground contact 30. As the mini-card 200 is coupled with the connector 10, all of the base contacts 25, 30, 36, including the ground contact 30 are deflected by the mini-card base contact 215 in the directions N1 and W1 shown in FIG. 8. Deflection in the direction N1 loads the ground contacts 30 to provide the normal force for establishing and maintaining an electrical connection between the ground contact 30 and the mini-card base contact 215. Movement in the W direction causes the contact surface 220 of the ground contact 30 to wipe the mini-card base contact 215, thus removing or reducing any film layer coating either contact 30, 215 and enhancing the gold-to-gold connection.

The signal contacts 40 are deflected by the top surface 210 of the notch 205 in the directions N2 and W2. Similar to the case described above with respect to the ground contact 30, deflection in the direction N2 loads the signal contacts 40 to provide the normal force for establishing and maintaining an electrical connection between the signal contacts 40 and the mini-card signal contacts (not shown). Movement in the W2 direction causes the contact area 180 of the signal contact 40 shown in FIG. 8) to wipe the mini-card signal contact (not shown). In the illustrated embodiment, the normal deflections N1, N2 are about 0.020 inches (i.e., about $1/6^{th}$ the beam length of the finger 155). To support this ratio of deflection to beam length, the material of construction of the signal contacts 40 should have adequate yield strength. In the illustrated embodiment, the signal contacts 40 are formed of beryllium copper.

The connector 10 may be mounted to the printed circuit board 12 using a surface mount process. Because of the floating latch 45, the connector base 15 and contact housing 20 may move independently to conform to the surface of the printed circuit board 12. Because the PCB feet 60, 62 are soldered to the printed circuit board 12 gold-to-gold contact surfaces are not required on either the PCB feet 60, 62 or the printed circuit board 12. Soldered permanent connections are generally less expensive and more stable than separable gold-to-gold connections. Also, the hole 162 (shown in FIGS. 5 and 8) defined in the base 160 over the PCB foot 60 allows the contact area (not shown) between the PCB foot 60 and the interfacing contact (not shown) to be visually inspected (manually or by machine) to verify the adequacy of the solder connections. These features increase the robustness of the connector 10 by increasing the repeatability, and the reliability of the surface mount process.

The materials of the connector 10 are chosen to be compatible with the heat encountered during a surface mount process. The connector base 15 and contact housing 20 are formed of a 30% liquid crystal polymer compound such as Vectra® sold by the Celanese Corporation of Summit, N.J. Other compatible materials suitable for a surface mount process are contemplated.

In the embodiment illustrated by FIG. 8, features for retaining the connection between the mini-card 200 and the connector 10 are not shown. These retaining features may be integrated in the housing (not shown) of the device (not shown) containing the connector 10.

Figure 9:
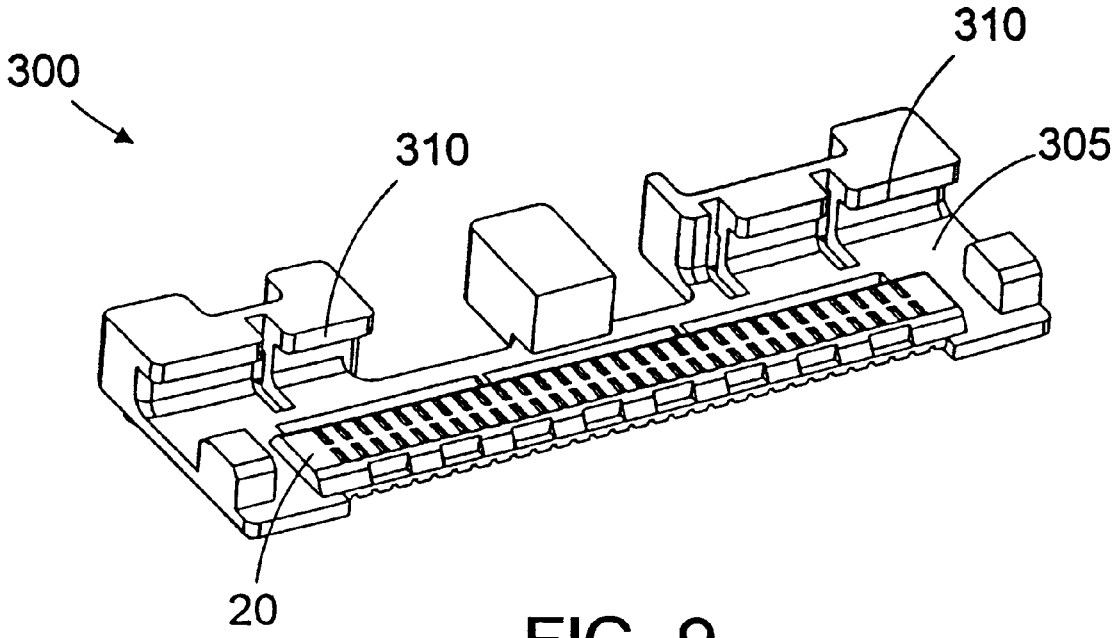
FIG. 9 is an isometric view of an alternative embodiment of a connector in accordance with the present invention.

FIG. 9 illustrates an isometric view of an alternative embodiment of the connector 10 of FIG. 1. The connector 300 of FIG. 9 includes a connector base 305 and contact housing 20. The connector base 305 includes a lip 310. The lip 310 acts as a hinge point for the leading edge of the mini-card 200 of FIG. 8 as it is being rotated and engaged with the connector 300. The lip 310 also helps retain the physical connection between the connector 300 and the mini-card 200 if the device (not shown) containing the connector 300 is jarred.

Integrating the hinge point into the lip 310 of the connector base 305 lessens the stringency of tolerances used in manufacturing the housing (not shown) of the device (not shown) containing the connector 300 and mini-card 200, as it is no longer the device housing (not shown) that includes retaining features for securing the mini-card 200 in the connector 300. Due to the retention function of the lip 310, an upward force may be applied to the connector base 305 during insertion and removal of the mini-card 200. The solder connections between the PCB feet 62 of the base contacts 25, 30, 35 and the printed circuit board 12 may be sufficient to counter this force. However, additional retention means (not shown) may be used to further secure the connector 300 to the printed circuit board 12.

Figure 10:
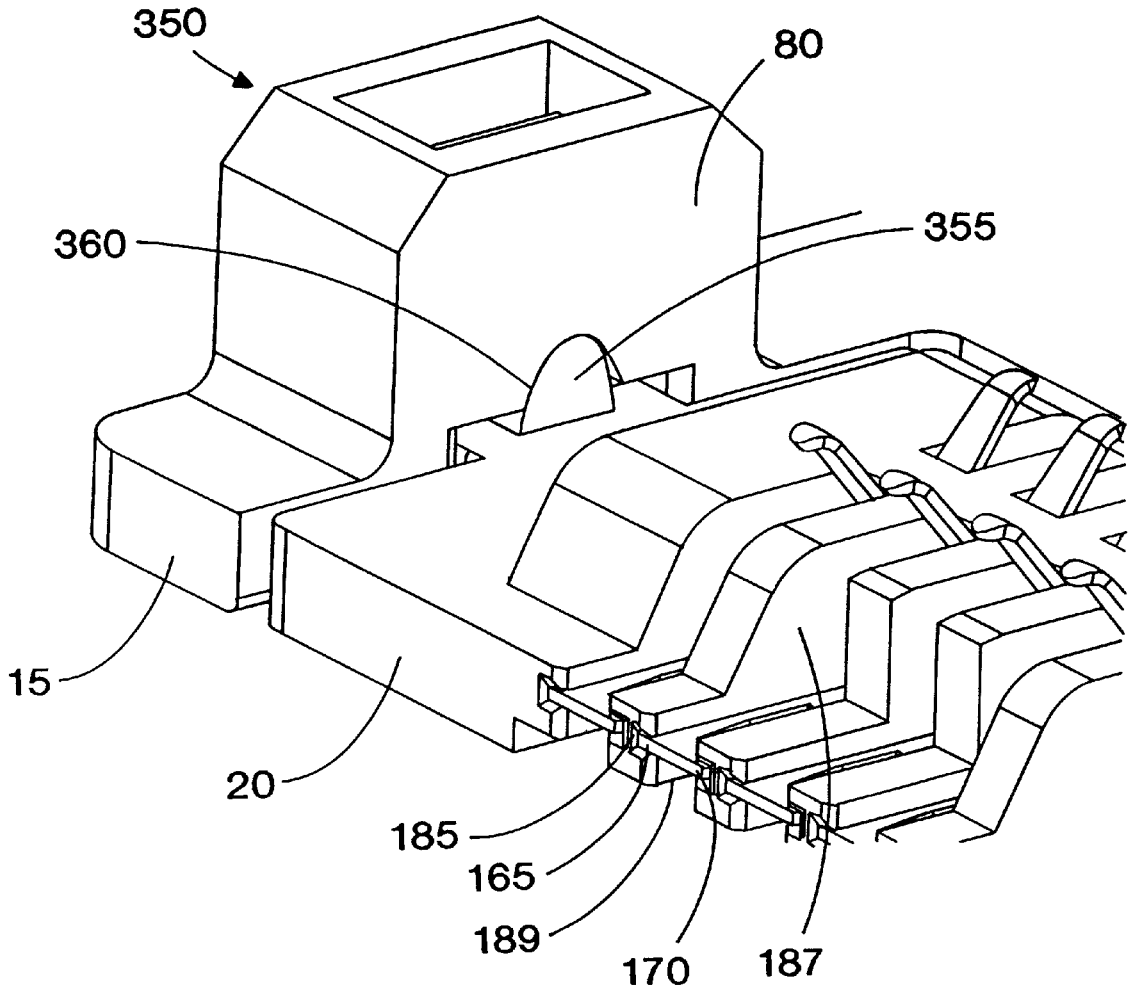
FIG. 10 is a partial isometric view of the connector of FIG. 1 including an alternative embodiment of the floating latch shown in FIG. 1.
Figure 11:
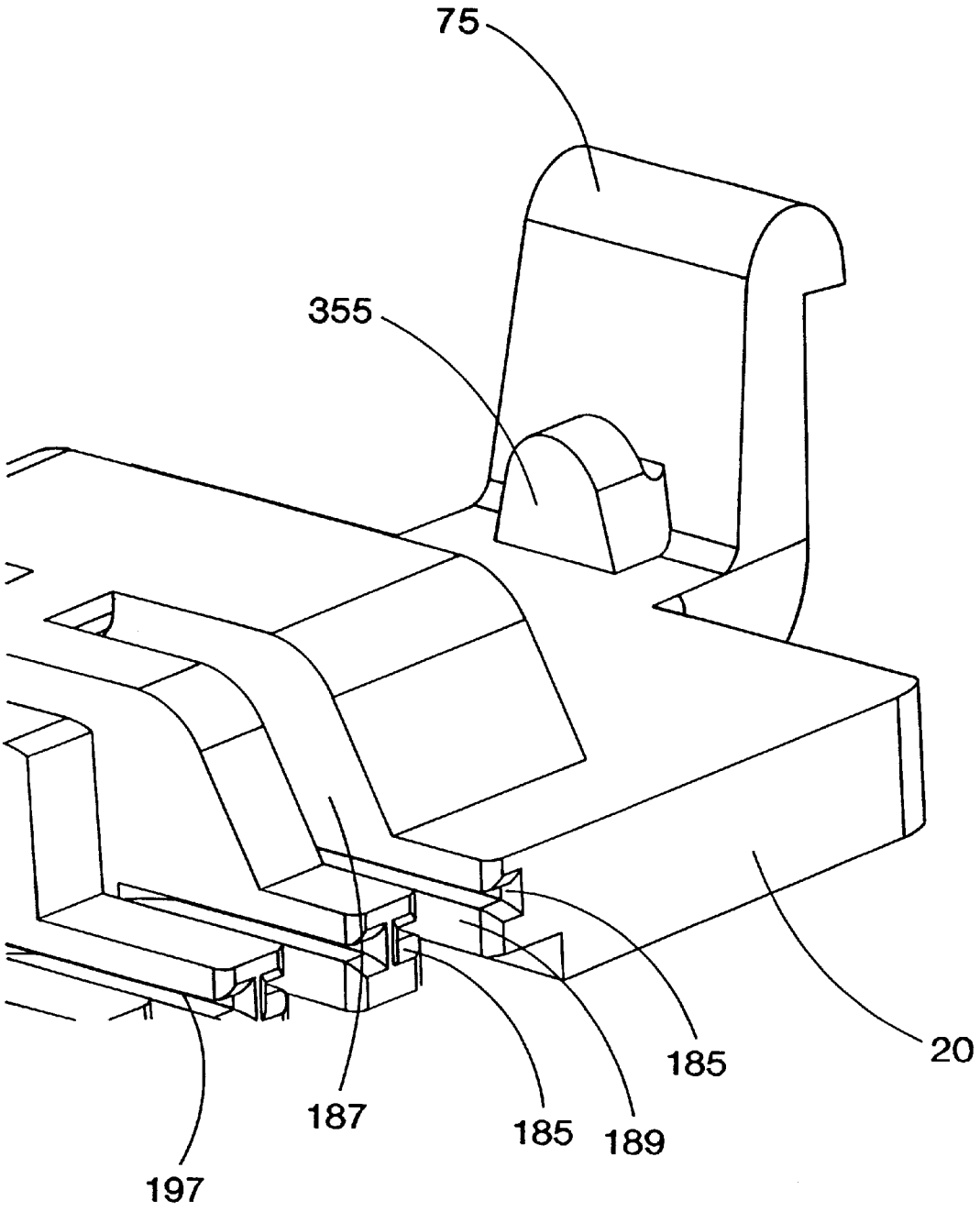
FIG. 11 is a partial isometric view of the contact housing of FIG. 10.

FIGS. 10 and 11 illustrates an alternative embodiment of a floating latch 350 for coupling the connector base 15 to the contact housing 20. The floating latch 350 includes a pivoting surface 355 defined in the contact housing 20 proximate the hook 75 (shown in FIG. 11). A notch 360 defined in the fastening flange 80 cooperates with the pivoting surface 355 to limit the freedom of movement of the contact housing 20 to rotation about the longitudinal axis of the contact housing 20. Accordingly, the contact housing 20 can rotate to conform to the surface of the printed circuit board 12 (e.g., to account for possible flexing of the printed circuit board 12), but the contact housing 20 still remains parallel with the connector base 15.

Figure 13:
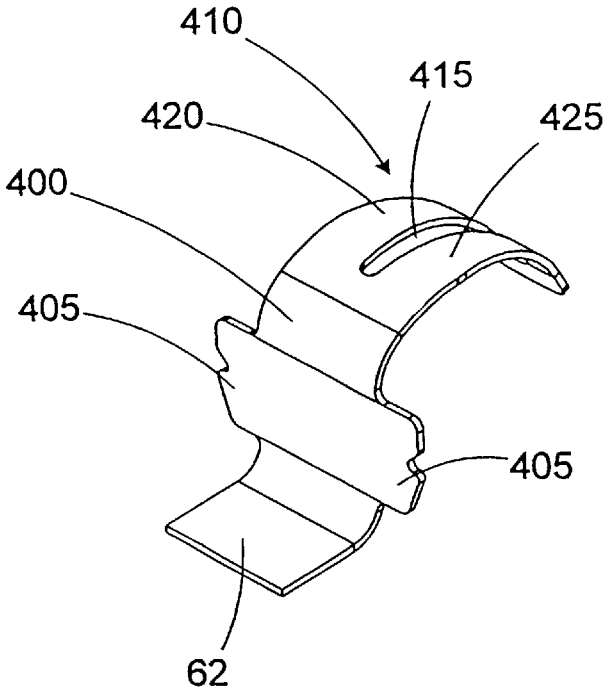
FIG. 13 is an isometric view of an alternative base contact.

FIG. 13 illustrates an alternative embodiment of a base contact 400. The base contact 400 includes retention tabs 405 for achieving an interference fit with the contact base 15. The contact surface 410 of the base contact 400 includes a tapered hole 415 defined therein for enhancing the strength deflection, and stability of the base contact 400. The hole 415 provides a split-beam contact surface having redundant contact mating surfaces 420, 425. The redundant contact mating surfaces 420, 425 increase the compliancy of the base contact 400 and enhance the electrical connection formed between the mating surfaces 420, 425 and the interfacing contact (not shown).

Figure 14:
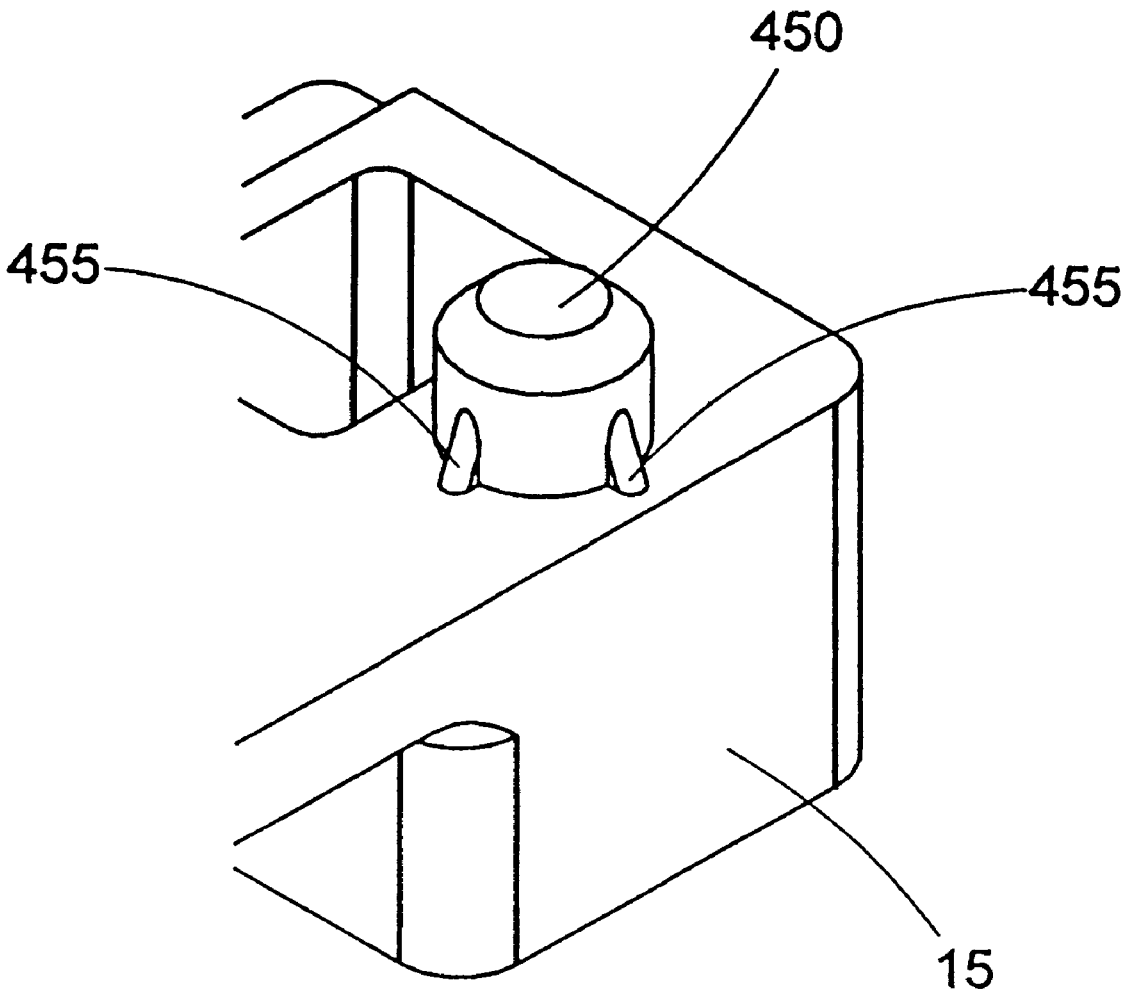
FIG. 14 is an isometric view of a mounting post used to mount the connector of FIG. 1 to the printed circuit board.

FIG. 14 is an isometric view of an alternative mounting post 450 defined in the contact base 15 for interfacing with the hole 57 defined in the printed circuit board 12. The mounting post 450 has tapered crush ribs 455 defined about its periphery. The tapered crush ribs 455 are deformed when the contact base 15 is coupled to the contact base 15, thus enhancing the physical connection therebetween. Also, because the crush ribs 455 are tapered, they will act to center the mounting post 450 within the hole 57. This centering enhances the accuracy of the placement of the contact base 15 relative to the printed circuit board 12. To ensure that the crush ribs 455 center the mounting post 450, it is contemplated that at least three crush ribs 455 be defined on the mounting post 450. The mounting post 450 with crush ribs 455 is particularly useful when the contact base 15 is being manually mounted to the printed circuit board 12.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An electrical connector comprising:

multiple first electrical contacts arranged in rows;

second electrical contacts comprising, at least a power contact and at least a ground contact;

the first electrical contacts and the second electrical contact having respective feet for making mating connections to a circuit board;

the feet on the first electrical contacts being moveable into position on said circuit board independently of the feet on the second electrical contacts being moveable into position on said circuit board, the first electrical contacts being in a contact housing, and the second electrical contacts being in a connector base that is separate from the contact housing;

the contact housing having a latch that is latched to the connector base;

the connector base having means for mounting the connector base to said circuit board; and the latch being floatingly retained by the connector base, whereby the contact housing and the connector base are adapted for floating movement relative to each other, which allows the contact housing and the connector base to conform to an irregular surface of said circuit board independently of each other, to increase a likelihood of the respective feet making said mating connections to said circuit board.

2. An electrical connector as recited in claim 1, and further comprising: the contact housing having preloading structure deflecting each of the first electrical contacts to a final deflection angle.

3. An electrical connector as recited in claim 1, and further comprising: the contact housing having preloading structure deflecting each of the first electrical contacts to a final deflection angle, and the first electrical contacts are slid along slots in the contact housing and engage the preload structure.

4. An electrical connector as recited in claim 1, and further comprising: the connector base having a notch, and the contact housing having a pivoting surface that pivots in the notch, whereby the contact housing and the connector base pivot relative to each other, which allows the contact housing and the connector base to conform to an irregular surface of said circuit board independently of each other.

5. An electrical connector as recited in claim 4, and further comprising: the contact housing having preloading structure deflecting each of the first electrical contacts to a final deflection angle.

6. An electrical connector as recited in claim 4, and further comprising: the contact housing having preloading structure deflecting each of the first electrical contacts to a final deflection angle, and the first electrical contacts are slid along slots in the contact housing and engage the preload structure.

* * * * *